United States Patent [19]

Hadlock

[11] 4,281,710

[45] Aug. 4, 1981

[54] HEAT EXCHANGER

[75] Inventor: Fred Hadlock, Glendale, Oreg.

[73] Assignee: FRAC, Inc., Glendale, Oreg.

[21] Appl. No.: 954,554

[22] Filed: Oct. 25, 1978

[51] Int. Cl.[3] ..... F28D 7/12; F28F 9/22

[52] U.S. Cl. ..... 165/142; 165/160

[58] Field of Search ..... 165/141, 142, 154, 155, 165/156, 160, 161, 179; 62/512; 122/406 R

[56] References Cited

U.S. PATENT DOCUMENTS

| | | | |
|---|---|---|---|
| Re. 2,292 | 6/1866 | Fischer | 165/155 |
| 664,186 | 12/1900 | Strobel | 122/406 R |
| 1,801,693 | 4/1931 | Ruff | 165/156 |
| 3,196,198 | 7/1965 | Rex | 165/154 |

FOREIGN PATENT DOCUMENTS

| | | | |
|---|---|---|---|
| 350104 | 10/1905 | France | 165/155 |
| 891644 | 3/1962 | United Kingdom | 165/179 |

*Primary Examiner*—Alfred E. Smith
*Assistant Examiner*—Janice A. Howell
*Attorney, Agent, or Firm*—Jack M. Wiseman; Francis W. Anderson

[57] ABSTRACT

A heat exchanger has a cylindrical shell closed at its ends. A large conduit of circular cross-section, which extends longitudinally through the shell, is concentric with the shell to define a central passage for a first heat exchange medium such as a cool gas, and an outer annular passage for a second heat exchange medium, such as a hot liquid. Four radially oriented fins divide the two passages into quadrantal chambers or zones, and two tubes, one extending into each end of the shell, carry the second medium into and remove it from the annular passage.

4 Claims, 3 Drawing Figures

HEAT EXCHANGER

BACKGROUND OF THE INVENTION

This invention relates to heat exchangers of the type in which fluid passing through one conduit heats or cools fluid surrounding the conduit.

In general, the effectiveness of a heat exchanger using two heat exchange fluids depends upon its ability to transfer heat between the fluids. In typical devices, the transfer is accomplished by passing the two fluids along opposite sides of a heat transfer member such as a metal plate or tube. Also vanes or fins have been employed which extend from one fluid-flow passage to the other to effect a heat transfer. It is, of course, desirable to obtain as much contact between the moving fluid and the heat transfer member or members. The patent to Wulf, U.S. Pat. No. 3,087,253 discloses vanes extending entirely across both a center flow passage and an enclosing annular passage. The heat exchanger of the patent to Powers, U.S. Pat. No. 2,291,985, discloses similar vanes extending part way across the flow passages. The patent to Strobel, U.S. Pat. No. 664,186, and that to Kasten, U.S. Pat. No. 3,200,948, disclose vanes in longitudinal chambers that do not extend to the ends of the chambers so that the fluid must reverse its flow direction as it moves along a heat transfer member. As pointed out above, each device features an arrangement which in one way or the other provides contact between the fluids and the heat transfer member of the device.

Other patents of interest are:
U.S. Pat. No. 3,446,278
U.S. Pat. No. 3,731,731
U.S. Pat. No. 3,453,840

SUMMARY OF THE INVENTION

The heat exchanger of the present invention includes an elongated generally cylindrical shell closed at both ends with a central tubular conduit extending longitudinally therethrough to provide a passage for relatively cool saturated gas leaving an evaporator of a refrigeration system. The annular passage defined between the central conduit and the shell receives a relatively hot liquid from a condenser in the system. The liquid flows in a circuitous path in the annular passage due to the fact that a tube which delivers the liquid into the passage has its inlet at one end of the passage while the tube which removes the liquid from the passage has its inlet at the opposite end of the passage. Thus, the liquid must travel along the length of the passage before it reaches the inlet of the discharge tube. During this movement of the liquid longitudinally of the annular passage, it can move laterally over the surfaces of radially-disposed heat-transfer fins and around the outermost edges of the fins into adjacent chambers defined by the fins. Also, it can flow around the ends of the fins into adjacent chambers due to the fact that the ends of the fins are spaced from the ends of the shell.

The fins divide the shell into quadrantal chambers or zones and the inlet and outlet tubes are located in the same quadrantal chamber so that a flow of liquid can be generated from the chamber in which the tubes are disposed, around the ends or side edges of the fins into adjacent chambers, and back to the initial chamber before leaving the shell. In each chamber the liquid can contact the heat-transfer vanes or the heat-transfer surface of the central tube.

Due to the arrangement of the fins and the inlet and discharge tubes of the present heat exchanger, the heat exchange medium in the outer annular chamber has advantageous contact with the fins and the central tube for an effective length of time.

It is an object of the present invention to provide an arrangement of flow-directing members in a chamber of a heat exchanger such that the fluid passing through the chamber has improved, effective contact with the heat-transfer members of the apparatus.

A feature of the present invention is the high efficiency resulting from the heat exchanger in that it recovered energy previously "spent". It was found that less current was drawn from the compressor and yet a lower temperature was recorded in the refrigerated area calculated in a working environment.

DESCRIPTION OF THE PREFERRED EMBODIMENT

Figure 2:
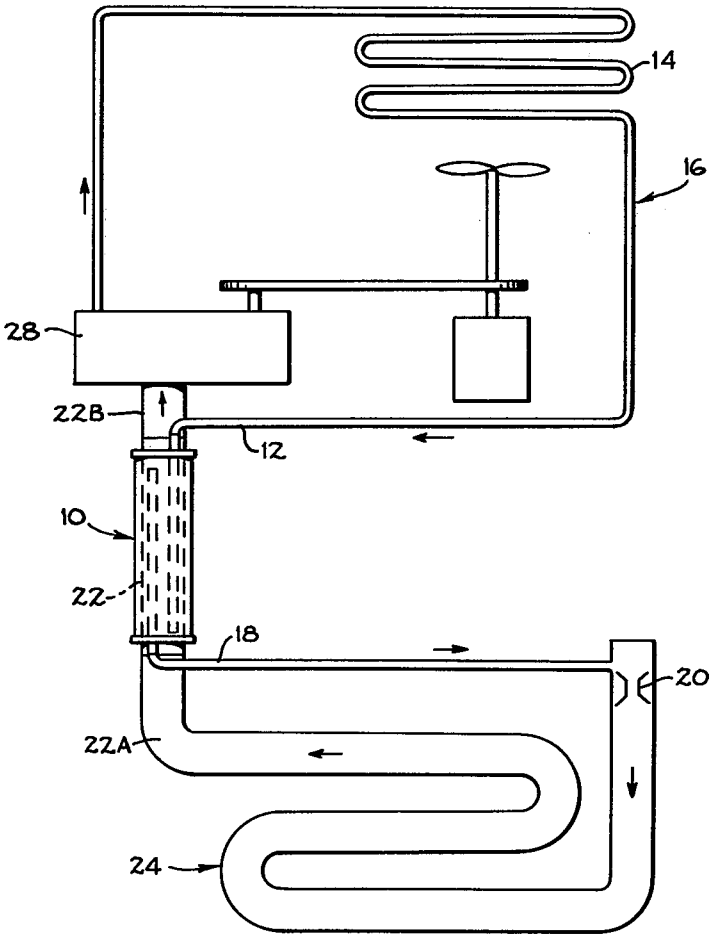
FIG. 2 is a diagrammatic illustration of one system in which the heat exchanger of the present invention may be used.
Figure 1:
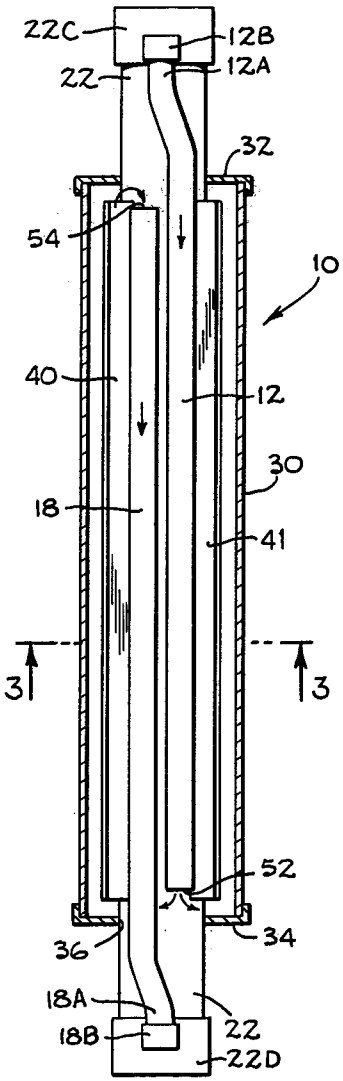
FIG. 1 is an elevation of the heat exchanger of the present invention with the outer shell shown in section.

The heat exchanger 10, illustrated in FIG. 1, has general utility in any system wherein a relatively cool heat-exchange medium such as a refrigerant is passed through a housing in one direction, while another or the same medium at a different temperature is also directed through the housing. In the preferred embodiment, essentially all components of the heat exchanger 10 are made of copper. In FIG. 2, a typical installation is illustrated wherein the heat exchanger 10 receives relatively hot liquid from a conduit 12 leading from the condenser 14 of a refrigerating unit 16, and discharges it at a lower temperature through a conduit 18 leading to an expansion valve 20 of the refrigeration system. At the same time, the heat exchanger 10 receives relatively cool saturated gas from one end 22A of a conduit 22 leading from an evaporator 24 of the system and discharges it at a higher temperature through the other end 22B of conduit 22 leading to a compressor 28.

The heat exchanger comprises an outer cylindrical shell 30 (FIG. 2) having two end closure caps 32 and 34, respectively, welded thereon. The large conduit 22, which is of generally circular cross-section, enters the lower end of the housing through a circular opening 36 in the cap 34 and is secured therein by a weld or another suitable gas-tight connection. Similarly, this conduit 22 passes through the upper end cap 32 in sealed and fixed engagement therewith.

Figure 3:
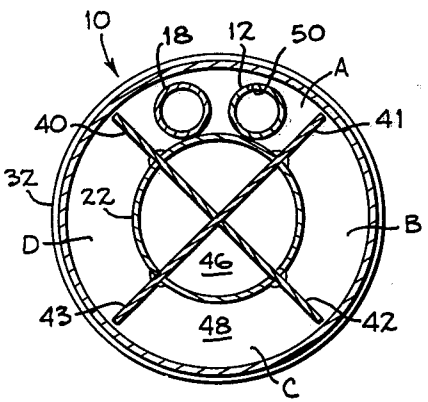
FIG. 3 is a section taken along lines 3—3 of FIG. 1.

At a portion of the large conduit 22 that is located between the end caps 32 and 34, the conduit is provided with four heat-transfer fins 40–43 (FIG. 3) in the form of rectangular plates which engage each other and are rigidly connected approximately along the longitudinal centerline of the conduit 22. In the exemplary embodiment, the fins 40–43 are made of copper. Each fin extends generally radially outwardly from its center connection and passes through a slot in the large conduit 22 as shown in FIG. 3. The fins are secured to the conduit at these slots by welding so that the center passage 46 provided by the conduit 22 is sealed off from the annular passage 48 defined between the conduit 22 and the inner wall of the shell 30.

It is to be particularly noted that the fins 40–43, which divided the inner and outer passages into four quadrantal zones A, B, C and D, do not extend entirely across the annular passage 48 and, accordingly, liquid in the passage 48 cannot only pass longitudinally along the passage, but can also move in a generally circular manner from one zone to another as it moves longitudinally. Also, it will be seen in FIG. 1 that each end of each fin is spaced from the adjacent end cap to provide flow passages around the ends of the fins.

The structure of the fins allows rapid transfer and equalization of the extremely different temperatures of the liquid from the conduit 12 and gas from the conduit 22.

The relatively small conduit 12 leading from the condenser 14 enters the quadrant A of annular passage 48 of the heat exchanger through an opening 50 (FIG. 3) in the upper end cap 32. The conduit 12 extends through the cap in close fitting engagement and, as seen in FIG. 1, it has a discharge opening 52 at a point spaced from the end cap 34. The conduit 18, which removes from the heat exchanger the liquid brought into it by conduit 12, is also positioned in zone A but is not directly connected to conduit 12. Rather conduit 18, which extends in close fitting engagement through the end cap 34, has an inlet 54 at a point close to the end cap 32. Therefore, liquid entering the heat exchanger through conduit 12 travels substantially the length of the housing, is discharged from opening 52, and has its direction of travel reversed as it is dispersed in the annular chamber 48 so that it flows back through chamber 48 to the inlet opening 54 where its direction of travel is again reversed so that it travels in its original direction until it leaves the heat exchanger.

Referring to FIGS. 1 and 3, it will be seen that relatively hot liquid will enter the heat exchanger through conduit 12 and pass along the length of the shell until it is discharged at opening 52. The liquid passes around the longitudinal ends of the fins 40–43 and around the radially outer edges of the vanes and works its way longitudinally of the passage 48 toward the inlet opening 54 of conduit 18. It will be noted that, during this longitudinal movement of the liquid in annular passage 48, it is in heat-transfer relation with the outer surface of conduit 22 carrying relatively cool fluid and with the portions of the fins 40–43 that extend into the annular chamber 48.

The liquid in and out of the tubes reaching from one end to the other provides better distribution of the liquid to result in an improved transfer of the opposing saturated gas temperature.

Also in FIG. 3 it is seen that the relatively cool gas passing along the conduit 22 is in heat-transfer relation with the inner portions of the fins that are in passage 46. Accordingly, the relatively hot liquid in the annular passage 48, due to its contact with the outer surface of conduit 22 and with fins 40–43, will give up some of its heat to the gas passing along the interior of conduit 22.

The heat-exchanger of the present invention is symmetrical, with the exception of the inlet and discharge tubes 12 and 18 respectively which, as seen in FIG. 3, are located equidistantly from a central plane passing longitudinally through the unit. In FIG. 1, the tubes 12 and 18 are illustrated as having offset extensions 12A and 18A respectively, which are in longitudinal alignment with each other, with the aforementioned plane passing centrally through the extensions. Thus, the heat exchanger is non-directional and can be reversed end for end during installation in a system. The heat exchanger has greater installation versatility.

The heat exchanger is connected into the system by coupling members 22C, 22D, 18B and 12B schematically shown in FIG. 1.

While four vanes have been illustrated and the flow passages have been divided into quadrantal zones, it will be evident that other numbers of vanes may be employed.

It will be evident also that the heat exchanger of the present invention has a large range of application and its use is not limited to the refrigeration system shown in FIG. 2. For example, in the refrigerating field it can be effectively employed not only in refrigerating systems used for high temperature air conditioners but in subzero systems.

The heat exchanger of the present invention requires less oil pumping by the compressor because the superheated gas coming back from the compressor is expanded to a degree greater than the expansion of gases in conventional heat exchangers. This reduces the expansion requirements of gases in the crankcase of the compressor and causes less oil to leave the compressor for circulating through the system. Thus, the heat exchanger requires less pumping of oil from the compressor and less current flow in the compressor. As a consequence thereof, there is less compressor damage.

From the foregoing description, it will be apparent that the present invention provides an effective flow of heat exchange medium around the ends and radial outer edges of heat-transfer fins and the longitudinal flow of the medium as it moves along in contact with the fins. The concept of dividing a flow chamber into quadrants, directing fluid into one quadrant, and removing the fluid from the same quadrant while permitting it to flow through the other three quadrants make possible a very effective heat-transfer operation.

Although the best mode contemplated for carrying out the present invention has been herein shown and described, it will be apparent that modification and variation may be made without departing from what is regarded to be the subject of the invention.

I claim:

1. In a heat exchanger having an elongate central conduit for a first heat-exchange fluid and an elongate annular conduit surrounding said central conduit and arranged to receive a second heat-exchange fluid, a plurality of heat-transfer fins extending radially of said central conduit and into said annular conduit, means for delivering heat-exchange fluid to said central conduit, a first tube extending into said annular conduit at one end thereof and having a discharge outlet near the opposite end of said annular conduit, and a second tube extending into said annular conduit at said opposite end and having an intake opening adjacent said one end whereby fluid entering said annular conduit through said first tube will move rearwardly over said fins as it moves toward the intake opening of said second tube.

2. A heat exchanger according to claim 1 including means providing passages around the outer edges of said fins for fluid moving rearwardly toward said intake opening.

3. In a heat exchanger, a first tubular member defining an inner passage for a heat transfer medium; a second tubular member surrounding said first member and defining an outer passage; a plurality of fins dividing said passages into a plurality of compartments, each fin extending from a point close to the longitudinal center of said first member, across said inner passage, and part way across said outer passage; an intake conduit extending lengthwise through one of said compartments of said outer passage from one end to the other in heat transfer relation with fluid therein and having a discharge opening at said other end for discharging fluid into said one compartment; a discharge conduit extending lengthwise through said outer passage in heat transfer relation with fluid therein and having an inlet opening at said one end; and means for directing a heat-transfer fluid through said inner passage to pass over the fins therein in heat-transfer relation, the fluid leaving the discharge opening of said first conduit being required to pass in a rearward direction over said fins to reach the inlet opening of said discharge conduit.

4. A heat exchanger according to claim 3 wherein said tubular members are concentric cylindrical members one disposed within the other and wherein said fins divide said passages into quadrants with said inlet and discharge conduits being disposed in the same quadrant of said outer passage.

* * * * *